US007051439B2

(12) United States Patent
Tomassetti

(10) Patent No.: US 7,051,439 B2
(45) Date of Patent: May 30, 2006

(54) RAZOR WITH REPLACEABLE SHAVE PRODUCT DISPENSER CANISTER

(76) Inventor: Louis D. Tomassetti, 2745 E. Atlantic Blvd., Suite 300, Pompano Beach, FL (US) 33062

( * ) Notice: Subject to any disclaimer, the term of this patent is extended or adjusted under 35 U.S.C. 154(b) by 0 days.

(21) Appl. No.: 11/023,606

(22) Filed: Dec. 23, 2004

(65) Prior Publication Data

US 2005/0132574 A1 Jun. 23, 2005

Related U.S. Application Data

(60) Provisional application No. 60/532,350, filed on Dec. 23, 2003.

(51) Int. Cl.
*B26B 21/44* (2006.01)

(52) U.S. Cl. ..... 30/41

(58) Field of Classification Search ..... 30/41, 30/41.5, 124, 125, 532, 535, 537, 538
See application file for complete search history.

(56) References Cited

U.S. PATENT DOCUMENTS 4,023,269 A * 5/1977 Lopez, Jr. ..... 30/41
4,077,119 A * 3/1978 Sellera ..... 30/41
4,433,483 A * 2/1984 Lazarus ..... 30/41
4,797,998 A * 1/1989 Motta ..... 30/530
5,016,351 A * 5/1991 Drahus ..... 30/41
5,070,611 A * 12/1991 Derin et al. ..... 30/41
5,564,190 A * 10/1996 Fleetwood ..... 30/41
5,600,887 A * 2/1997 Olson ..... 30/41.5
5,701,674 A * 12/1997 Mitchell ..... 30/41
5,761,813 A * 6/1998 Frick et al. ..... 30/41
6,112,412 A * 9/2000 Richard ..... 30/41.5
6,754,958 B1 * 6/2004 Haws et al. ..... 30/41
6,789,321 B1 * 9/2004 Simms ..... 30/41

* cited by examiner

*Primary Examiner*—Hwei-Sui Payer
(74) *Attorney, Agent, or Firm*—Robert M. Downey, P.A.

(57) ABSTRACT

A razor includes a handle, a flexible neck extending from the top of the handle and a blade-carrying razor head removably and pivotally fitted to grasping arm members extending from the neck. The handle portion is structured and disposed for receipt of a pressurized shave product dispensing canister therein. A lower portion of the handle functions as an actuator for dispensing the shaving product in the pressurized canister and is operable between a stop position and a dispensing position. The pressurized canister is removable from the handle to facilitate replacement and, in a preferred embodiment, includes a cap defining the actuator and forming the lower portion of the handle when the canister is inserted and operatively positioned within the handle. The flexible neck is formed with a scoop for directing a stream of water through the razor head in a flushing action in order to remove debris and residue which accumulates on the blades.

11 Claims, 5 Drawing Sheets

RAZOR WITH REPLACEABLE SHAVE PRODUCT DISPENSER CANISTER

BACKGROUND OF THE INVENTION

This application claims the benefit of U.S. Provisional patent application Ser. No. 60/532,350 filed on Dec. 23, 2003.

1. Field of the Invention

This invention relates to a razor which includes a built-in shave product dispenser and, more particularly, to a razor having a handle adapted to removably receive a pressurized shave product dispensing canister and, wherein, the combined handle and canister provide a handle end with a dispensing actuator that is operable between a stop position and a dispensing position.

2. Discussion of the Related Art

Over the years, razors have been developed, marketed and improved to address the needs of the consumer. One development in the relevant art proposes the combination of a razor with a shaving product dispensing container, wherein the container forms a part of the handle. Of particular relevance to the present invention is the U.S. patent to Derin, et al., U.S. Pat. No. 5,070,611, the contents of which are incorporated herein by reference. Derin, et al., provide a razor and dispenser wherein an aerosol container serves as part of the handle of the razor. The container includes a combination cap/actuator which dispenses shaving material when depressed. The cap/actuator may be depressed only when placed in a selected rotational position. When the cap/actuator is not in the selected operable position, a shoulder on the container and a skirt on the cap/actuator engage to prevent depression of the cap/actuator and, accordingly, dispensing of the shaving material. The Derin, et. al. razor and dispenser includes a handle with an integral rigid neck portion extending to a blade-carrying head. The head is fixed on the end of the neck and is not removable, nor is it able to pivot.

The razors in the prior art which include a combined shave product dispenser, such as the razor disclosed in Derin, et al. are all disposable products and fail to provide for the ability to recharge or replace the shaving product and/or the blades. Thus, the useful life of the razor is limited. When the shave product dispensing canister is empty or when the blades become dulled from use, the razor is discarded and the user must purchase a new product.

Accordingly, there remains a definite need in the shaving industry for a razor which provides for a replaceable shave product dispensing canister or cartridge in the handle portion of the razor and replaceable blade carrying heads. In this manner, when the shave product dispensing canister is empty, a new canister can be replaced in the handle. Likewise, when the blades of the head become dulled from use, the blade head can be removed and replaced with a new head having sharp blades.

OBJECTS AND ADVANTAGES OF THE INVENTION

With the foregoing in mind, it is a primary object of the present invention to provide a razor which includes a removable and replaceable pivoting blade carrying head and a removable and replaceable shave product dispensing canister or cartridge.

It is still a further object of the present invention to provide a combined razor and dispenser which dispenses a shaving product (e.g. shaving cream or shaving gel) from the handle of the razor, and wherein the handle portion of the razor is structured to permit insertion and removal of a pressurized canister or cartridge containing the shaving product, thereby allowing for replacement of the shaving product when the removable canister is empty.

It is still a further object of the present invention to provide a combined razor and dispenser which dispenses a shaving product from the handle of the razor, and wherein the shaving product is replaceable and, further wherein a pivoting blade carrying head is removable from the handle and replaceable, as needed.

It is still a further object of the present invention to provide a razor combined with a dispenser which dispenses a shaving product from the handle of the razor, and wherein the cartridge or canister containing the shaving product is replaceable when empty, and further wherein the neck of the razor handle includes a scoop structure for directing a stream of water through the blade carrying razor head in a manner which enhances flushing action in order to thoroughly rinse debris and residue which accumulates on the blades.

SUMMARY OF THE INVENTION

The present invention is directed to a razor having a handle, a flexible neck extending from the top of the handle and a blade-carrying razor head removably and pivotally fitted to flexible arm members extending from the neck. The handle portion is structured and disposed for receipt of a pressurized shave product dispensing canister therein. A lower portion of the handle functions as an actuator for dispensing the shaving product in the pressurized canister and is operable between a stop position and a dispensing position. The pressurized canister is removable from the handle to facilitate replacement and, in a preferred embodiment, includes a cap defining the actuator and forming the lower portion of the handle when the canister is inserted and operatively positioned within the handle. The flexible neck is formed with a scoop for directing a stream of water through the razor head in a flushing action in order to remove debris and residue which accumulates on the blades.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
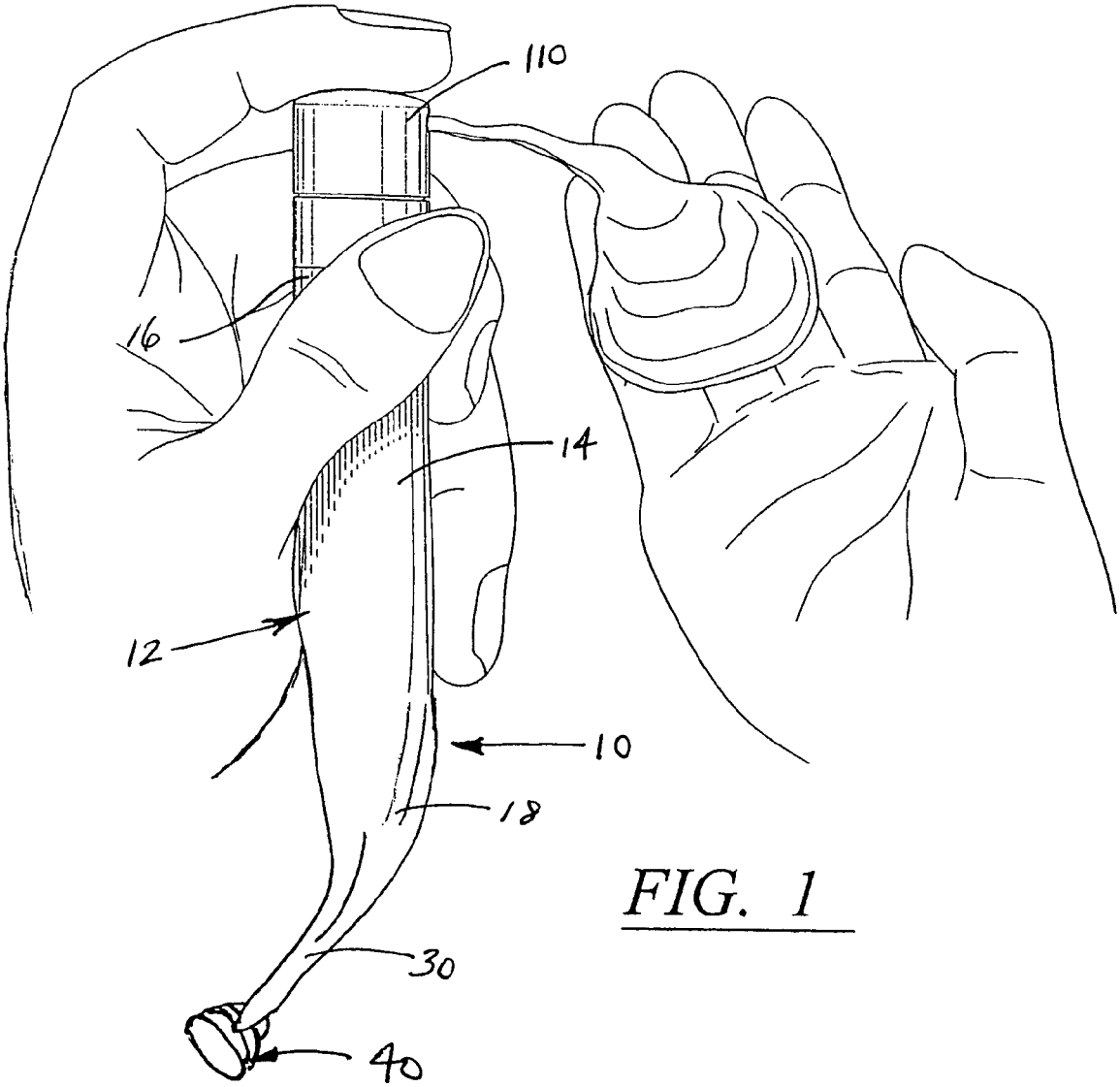
FIG. 1 is a perspective view showing the present invention in use and dispensing a shaving product into the hand of a user.

Referring to the several views of the drawings, and initially FIGS. 1–6, the razor of the present invention is shown and is generally indicated as 10. The razor 10 includes a handle 12 having a central portion 14 defining a grip zone, a lower portion 16 with an open end 17 and an upper portion 18. The handle portion is hollow and includes an interior chamber 20 communicating with the open end 17. The interior chamber, as described more fully hereinafter, is specifically sized, structured and configured for interlocking, removable receipt of a pressurized canister 100. The pressurized canister 100 contains a charge of a shaving product, such as shaving cream or shaving gel. The outer configuration of the handle may be shaped in any desired form for esthetic purposes, ergonomics, grip comfort and ease of control and manipulation of the razor when held in the user's hand.

Figure 2:
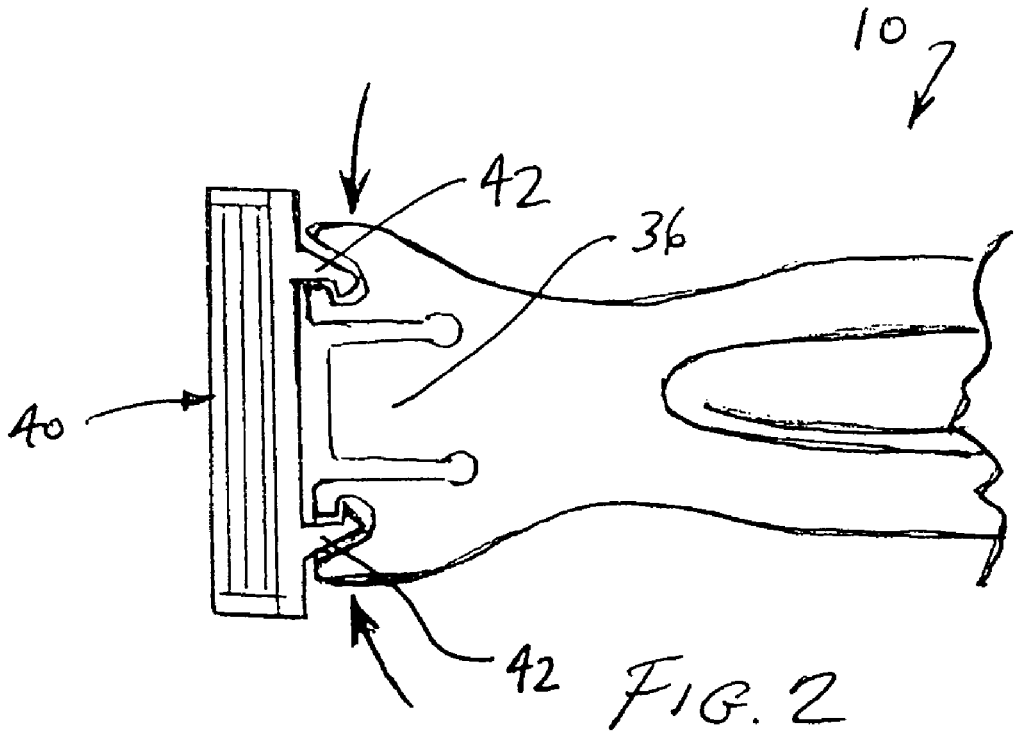
FIG. 2 is an isolated bottom plan view of a neck portion of the razor handle shown with the blade carrying head pivotally attached.
Figure 3:
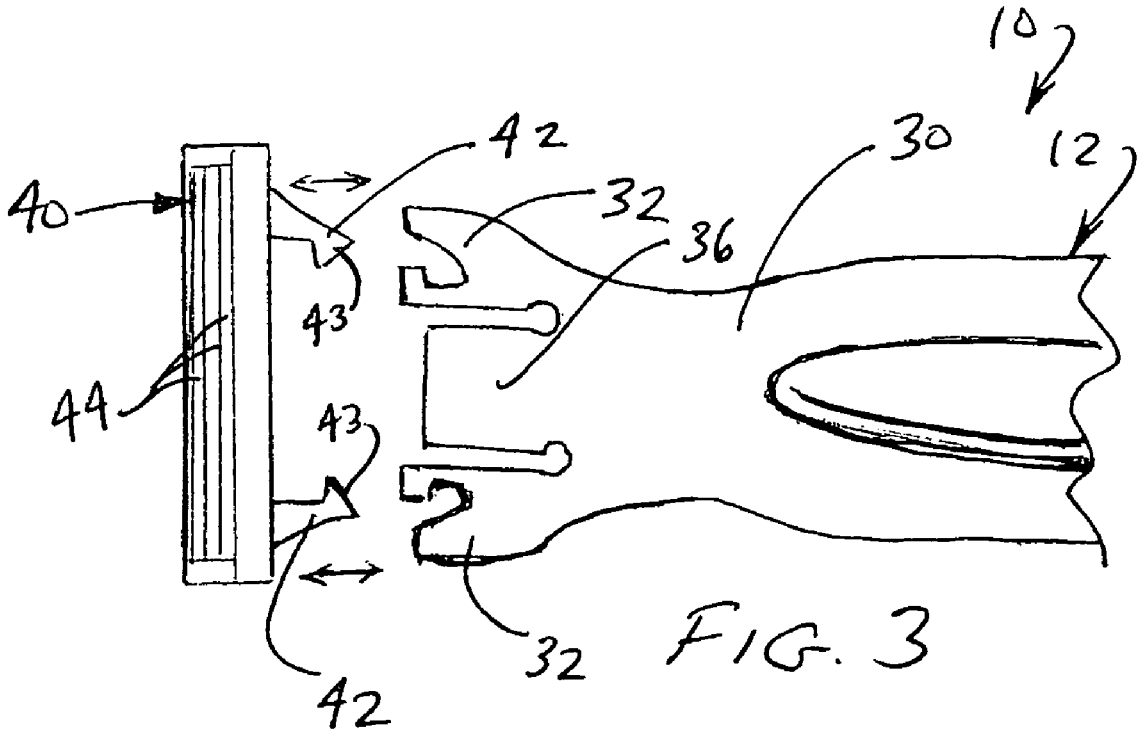
FIG. 3 is an isolated bottom plan view of the neck portion showing the blade carrying head removed from flexible arm grasping members.

The upper portion 18 of the handle 12 extends to an integral neck 30. The neck 30 terminates at grasping prong members 32 which are structured and disposed for interlocking receipt of a blade carrying head 40. More specifically, catch elements 42 on the blade carrying head are releasably and interlockingly received within the grasp of the prongs, as illustrated in FIGS. 2 and 3. Slots formed between the opposite grasping prongs 32 and a scoop structure 36 on the neck 30 provide a living hinge which enables the grasping prongs 32 to flex inwardly upon application of pressure with the thumb and index figure, as indicated by the arrows in FIG. 2, to release the grasping prongs from the catch elements on the blade carrying head, thereby allowing separation of the blade carrying head 40 from the razor handle 12. A new blade carrying head is attachable to the handle by pressing the grasping prongs 32 against the catch elements of the new blade carrying head 40 causing the grasping prongs to flex inwardly until the tips 43 of the catch elements 42 are received within the grasp of the prongs 32, as seen in FIG. 2. The scoop structure 36 on the neck is specifically structured and configured for directing running water (e.g. from a faucet) into a directed stream and through the blade carrying head 40, and between the individual blades 44, in order to effectively remove residue and debris which accumulates on the head and blade surfaces.

Figure 4:
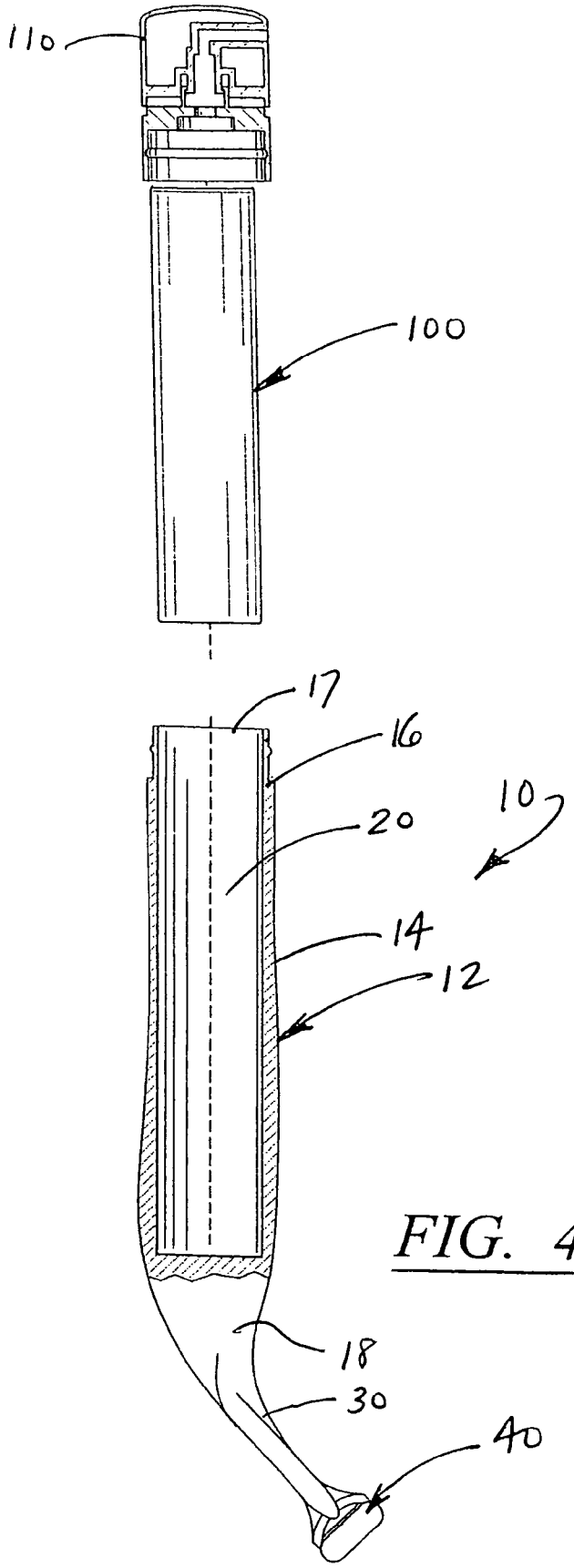
FIG. 4 is an exploded view showing a pressurized shave product containing canister and actuator cap removed from the hollow handle portion of the razor.
Figure 5:
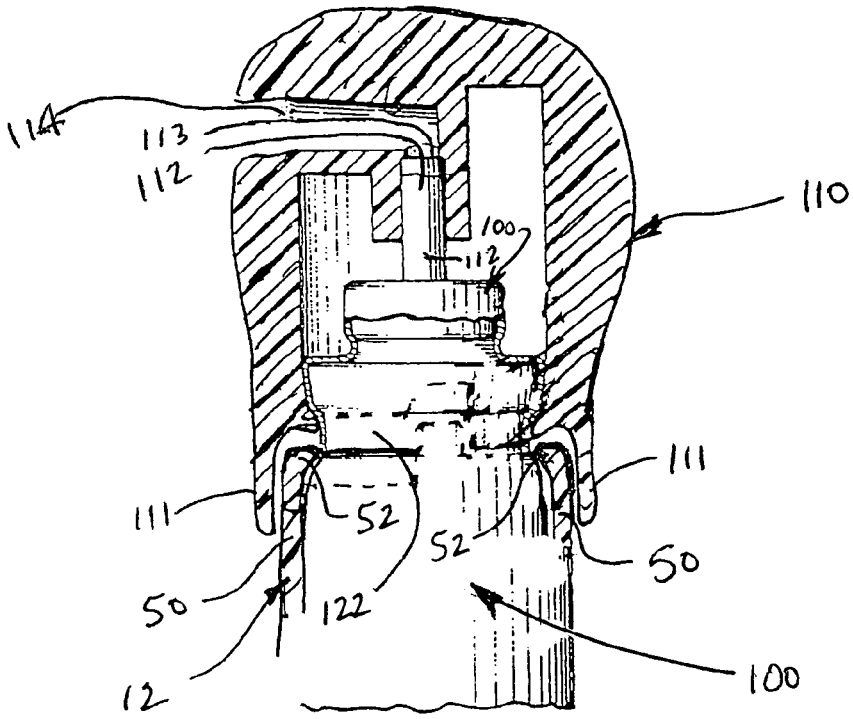
FIG. 5 is an isolated cross-sectional view of a lower end portion of the handle showing the pressurized canister and actuator cap operatively positioned within the handle and in an off position, wherein dispensing of the shave product from the canister is prevented.
Figure 6:
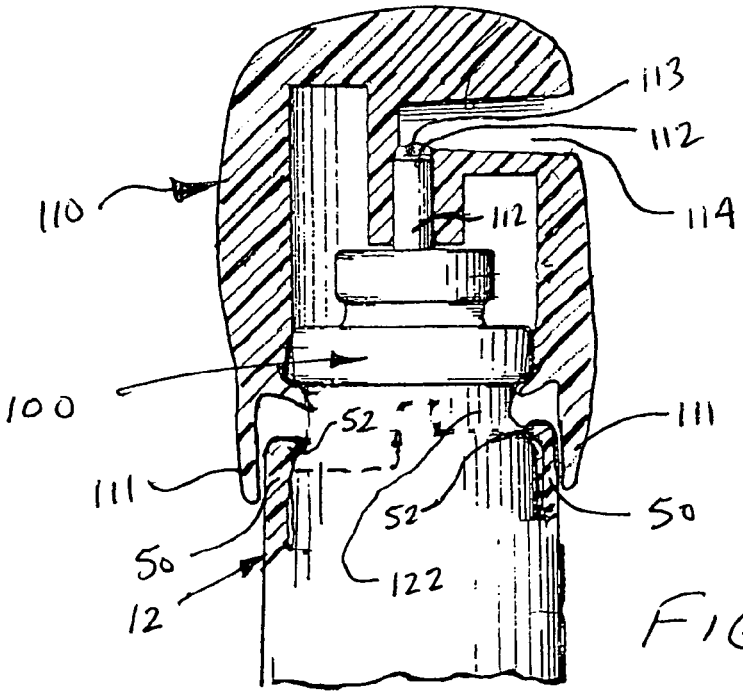
FIG. 6 is an isolated cross-sectional view of the lower end of the handle showing the pressurized canister and actuator cap operatively positioned within the handle and with the actuator cap in a dispensing position.

Referring to FIGS. 4–6, the manner of insertion and removable of the pressurized canister 100 within the chamber 20 of the handle 12 is shown in accordance with a preferred embodiment thereof. In this preferred embodiment, an actuator cap 110 is provided on the canister, in attachment to the nozzel stem 112 so that the open end 113 of the nozzle stem 112 is in fluid communication with a discharge passage 114 formed in the actuator cap 110. The canister 100 is inserted through the open end 17 and into the chamber 20 of the handle 12 as shown in FIG. 4, until flexible tabs 50, formed as part of the surrounding wall structure of the handle, interlock within the reduced diameter neck portion 122 of the canister 100. Specifically, protruding knuckles 52 on the flexible tabs 50 are urged within the reduced diameter area 122 of the canister, thereby releasably securing the pressurized canister 100 within the handle so that the canister does not inadvertently slide and fall out from the open end 17.

The actuator cap 110 includes a skirt portion 111 which extends over the gap between the open end 17 of the handle portion and the neck portion 122 of the canister. With the pressurized canister fully inserted in the operative position, as seen in FIGS. 5 and 6, the actuator cap serves as a bottom end of the handle, and may be formed and configured to conform with the overall external configuration of the handle 12. To dispense the shaving product from the pressurized canister, the actuator cap 110 is rotated to the position showing in FIG. 6, thereby enabling the actuator cap to be depressed inwardly, towards the handle portion, causing the valve stem 112 of the canister to be depressed. This results in discharge of the pressurized contents within the canister being released through the discharge passage and from the nozzle opening in the actuator cap, and into the user's hand, as shown in FIG. 1. In the preferred embodiment, the actuator cap 110 is operable between a stop position and a dispensing position by rotating the actuator cap in a similar manner as described and shown in connection with the razor device in U.S. Pat. No. 5,070,611. However, unlike the razor and dispenser in U.S. Pat. No. 5,070,611 to Derin, et al., the pressurized canister 100 and actuator cap 110 in the present invention are removable from the handle 12, thereby facilitating replacement of the canister with a fully charged canister, as needed.

Figure 7:
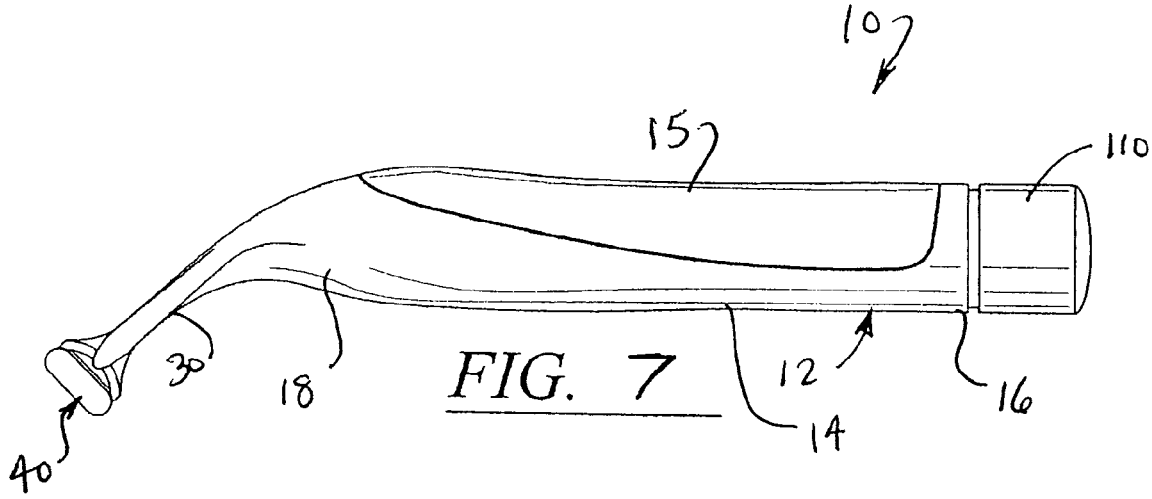
FIG. 7 is a side elevational view showing an alternative embodiment of the present invention.
Figure 8:
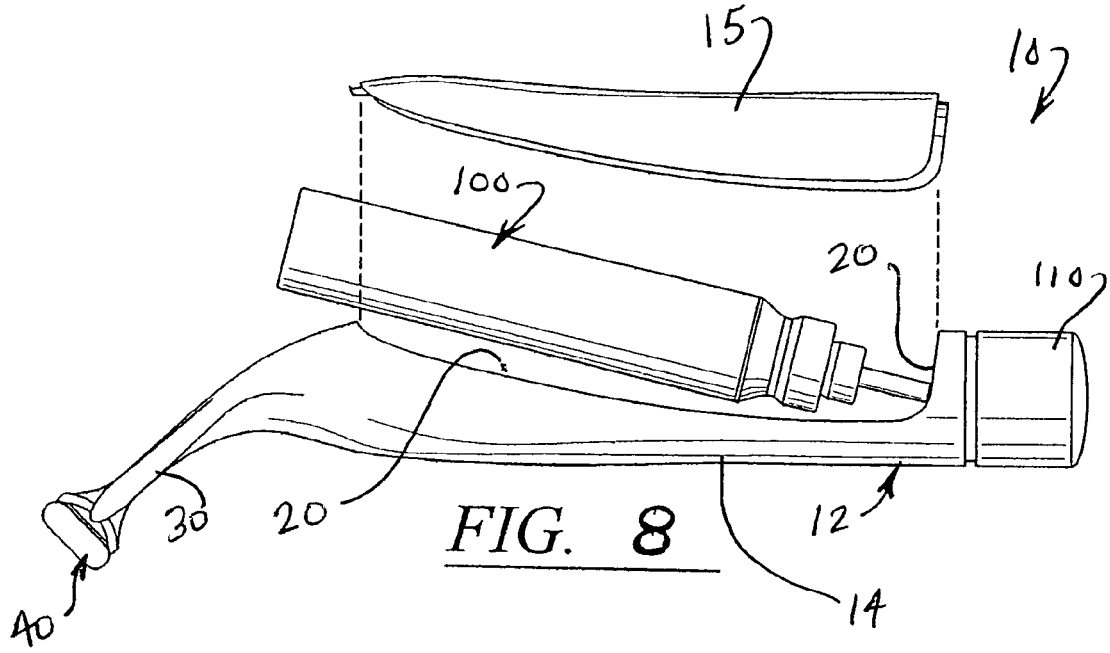
FIG. 8 is a side elevational view, partially exploded, illustrating the manner of insertion and removal of the pressurized canister within the handle portion of the embodiment of FIG. 7, wherein a cover forming a portion of the handle is removed, thereby permitting insertion and removal of the pressurized canister.

FIGS. 7 and 8 illustrate a further embodiment of the present invention, wherein the handle portion 12 includes a removable cover 15 for inserting and removing the pressurized canister 100 within the chamber 20. In this particular embodiment, the actuator cap 110 may remain attached to the end of the handle, and only the cover 15 needs to be removed in order to remove and replace the canister 100. The neck and blade attachment structure is the same as described in connection with the previous embodiment of FIGS. 1–6.

While the instant invention has been shown and described in accordance with preferred and practical embodiments thereof, it is recognized that departures from the instant disclosure are contemplated within the spirit and scope of the present invention which is limited only as defined in the following claims as interpreted under the Doctrine of Equivalents.

What is claimed is:

1. A razor comprising:

a handle having a central portion, a lower portion and an upper portion;

a canister containing a charge of shave product under pressure, and said canister including a neck portion and a nozzle stem extending from the neck portion, and said nozzle stem being moveably operable to release the pressurized shave product contents from within the canister;

said handle being structured for holding said canister;

an actuator cap fitted to said lower portion of said handle and in operative engagement with said nozzle stem of said canister, and said actuator cap having a discharge passage disposed in fluid communication with an open end of said nozzle stem, and said actuator cap being operable to exert a force on said nozzle stem so that the pressurized shave product contents are released from said canister and outwardly from said discharge passage and said actuator cap and said canister being removable from said handle;

a flexible neck extending from said upper portion of said handle and including a proximal portion and a distal portion;

a head fitted to said distal portion of said neck and having at least one blade carried thereon;

grasping prong members on said distal portion of said neck structured and disposed for interlocking grasping receipt of said head, to hold said head on said distal portion of said neck, and said grasping prong members being structured and disposed to yield to an external force applied to said distal portion of said flexible neck to release from said head and thereby allowing removal and replacement of said head.

2. The razor as recited in claim 1 wherein said handle includes an interior chamber sized and configured for removable receipt of said canister therein.

3. The razor as recited in claim 2 wherein said lower portion of said handle includes an open end disposed in communicating relation with said interior chamber, and said open end being sized and configured for removable receipt of said canister therethrough and into said interior chamber.

4. The razor as recited in claim 3 wherein said neck includes a scoop structured and configured for directing a flow of liquid into a directed stream and through said head to remove residue and debris from said at least one blade.

5. The razor as recited in claim 1 wherein said grasping prong members and said head are cooperatively structured and disposed to allow pivotal movement of said head relative to said distal portion through a range of arcuate movement upon application of external pressure thereto when said head is attached to said distal portion.

6. The razor as recited in claim 1 wherein said actuator cap is operable between a stop position to prevent discharge of the shave product from the canister and a dispensing position to permit selective discharge of the shave product from said canister and out from said discharge passage.

7. A razor comprising:

a handle having a central portion, a lower portion and an upper portion;

a canister containing a charge of shave product under pressure, and said canister including a neck portion and a nozzle stem extending from the neck portion, and said nozzle stem being moveably operable to release the pressurized shave product contents from within the canister;

said handle including an interior chamber sized and configured for removable receipt of said canister therein;

an actuator cap fitted to said lower portion of said handle and in operative engagement with said nozzle stem of said canister, and said actuator cap having a discharge passage disposed in fluid communication with an open end of said nozzle stem, and said actuator cap being operable to exert a force on said nozzle stem so that the pressurized shave product contents are released from said canister and outwardly from said discharge passage;

a flexible neck extending from said upper portion of said handle and including a proximal portion and a distal portion, and said actuator cap and said canister being removable from said handle;

a head pivotally fitted to said distal portion of said neck and having at least one blade carried thereon;

grasping prong members on said distal portion of said neck structured and disposed for interlocking grasping receipt of said head, to hold said head on said distal portion of said neck, and said grasping prong members being structured and disposed to yield to an external force applied to said distal portion of said flexible neck to release from said head and thereby allowing removal and replacement of said head.

8. The razor as recited in claim 7 wherein said neck includes a scoop structured and configured for directing a flow of liquid into a directed stream and through said head to remove residue and debris from said at least one blade.

9. A razor comprising:

a handle having a central portion, a lower portion and an upper portion;

a canister containing a charge of shave product under pressure, and said canister including a neck portion and a nozzle stem extending from the neck portion, and said nozzle stem being moveably operable to release the pressurized shave product contents from within the canister;

said handle being structured for removably holding said canister;

an actuator for selectively discharging the pressurized shave product contents from said canister;

said actuator including a cap fitted to said lower portion of said handle and in operative engagement with said nozzle stem of said canister, and said actuator cap having a discharge passage disposed in fluid communication with an open end of said nozzle stem, and said actuator cap being operable to exert a force on said nozzle stem so that the pressurized shave product contents are released from said canister and outwardly from said discharge passage;

a neck extending from said upper portion of said handle and including a proximal portion and a distal portion;

a head fitted to said distal portion of said neck and having at least one blade carried thereon;

grasping prong members on said distal portion of said neck, said grasping prongs members being structured and disposed for interlocking grasping receipt of said head to hold said head on said distal portion of said neck, and said grasping prong members being structured and disposed to yield to an external force applied to said distal portion of said neck to release from said head, and thereby allowing removal and replacement of said head on said distal portion of said neck; and said neck including a scoop structured and configured for directing a flow of liquid into a directed stream and through said head to remove residue and debris from said at least one blade.

10. The razor as recited in claim 9 wherein said handle includes an interior chamber sized and configured for removable receipt of said canister therein.

11. The razor as recited in claim 10 wherein said lower portion of said handle includes an open end disposed in communicating relation with said interior chamber, and said open end being sized and configured for removable receipt of said canister therethrough and into said interior chamber.

* * * * *